US009528070B2

(12) United States Patent
Tipton et al.

(10) Patent No.: US 9,528,070 B2
(45) **Date of Patent: *Dec. 27, 2016**

(54) STAR POLYMER LUBRICATING COMPOSITION

(75) Inventors: Craig D. Tipton, Perry, OH (US); Marina Baum, Chagrin Falls, OH (US); Barton J. Schober, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/297,926

(22) PCT Filed: Apr. 12, 2007

(86) PCT No.: PCT/US2007/066482

§ 371 (c)(1),
(2), (4) Date: Apr. 15, 2009

(87) PCT Pub. No.: WO2007/127615

PCT Pub. Date: Nov. 8, 2007

(65) Prior Publication Data

US 2009/0209440 A1 Aug. 20, 2009

Related U.S. Application Data

(60) Provisional application No. 60/745,422, filed on Apr. 24, 2006.

(51) Int. Cl.
*C10M 161/00* (2006.01)

(52) U.S. Cl.
CPC ..... *C10M 161/00* (2013.01); *C10M 2201/085* (2013.01); *C10M 2205/02* (2013.01); *C10M 2207/282* (2013.01); *C10M 2209/084* (2013.01); *C10M 2209/086* (2013.01); *C10M 2215/042* (2013.01); *C10M 2215/08* (2013.01); *C10M 2215/28* (2013.01); *C10M 2217/024* (2013.01); *C10M 2217/028* (2013.01); *C10M 2217/043* (2013.01); *C10M 2219/106* (2013.01); *C10M 2223/04* (2013.01); *C10M 2223/043* (2013.01); *C10M 2223/045* (2013.01); *C10M 2223/049* (2013.01); *C10M 2227/061* (2013.01); *C10N 2220/021* (2013.01); *C10N 2220/029* (2013.01); *C10N 2220/033* (2013.01); *C10N 2240/04* (2013.01); *C10N 2240/042* (2013.01); *C10N 2240/044* (2013.01); *C10N 2240/045* (2013.01); *C10N 2240/046* (2013.01); *C10N 2240/08* (2013.01); *C10N 2240/10* (2013.01)

(58) Field of Classification Search
CPC ..... C10M 2215/28; C10M 2215/08; C10M 2223/043; C10M 2223/045; C10M 2227/061; C10M 2209/084
USPC ..... 508/186, 421, 441, 287, 188
See application file for complete search history.

(56) References Cited

U.S. PATENT DOCUMENTS

| | | | | |
|---|---|---|---|---|
| 5,070,131 | A | 12/1991 | Rhodes et al. | |
| 5,490,945 | A | 2/1996 | Smith et al. | |
| 5,955,405 | A | 9/1999 | Liesen et al. | |
| 6,586,375 | B1 | 7/2003 | Gahagan et al. | |
| 7,906,468 | B2 * | 3/2011 | Schmidt et al. | 508/469 |
| 2002/0147118 | A1 * | 10/2002 | Visger et al. | 508/466 |
| 2005/0038146 | A1 | 2/2005 | Fish, Jr. et al. | |
| 2006/0084583 | A1 * | 4/2006 | Tipton et al. | 508/287 |
| 2006/0189490 | A1 * | 8/2006 | Dardin et al. | 508/469 |
| 2007/0082827 | A1 * | 4/2007 | Schmidt et al. | 508/469 |
| 2009/0118150 | A1 * | 5/2009 | Baum et al. | 508/264 |

FOREIGN PATENT DOCUMENTS

| | | |
|---|---|---|
| EP | 0439254 | 7/1991 |
| EP | 0449374 | 10/1991 |
| EP | 0979834 | 2/2000 |
| WO | 9623012 | 8/1996 |
| WO | 9747661 | 12/1997 |
| WO | 2004087850 | 10/2004 |

OTHER PUBLICATIONS

Search Report from corresponding international application No. PCT/US2007/066945 dated Oct. 5, 2007.
Written Opinion from corresponding international application No. PCT/US2007/066945 dated Oct. 5, 2007.

* cited by examiner

*Primary Examiner* — Vishal Vasisth
(74) *Attorney, Agent, or Firm* — Eryn Ace Fuhrer; Teresan W. Gilbert

(57) ABSTRACT

The invention provides a lubricating composition containing (a) 0.1 to 15 wt % of a polymer with (i) a weight average molecular weight of 100,000 to 500,000; and (ii) a shear stability index of 10 to 60; (b) a phosphorus-containing acid, salt, or ester; (c) a dispersant; and (d) an oil of lubricating viscosity. The invention further provides a method for lubricating a mechanical device with the lubricating composition.

20 Claims, No Drawings

STAR POLYMER LUBRICATING COMPOSITION

This application is a 371 of PCT/US07/66482, filed Apr. 12, 2007 which claims benefit of 60/745,422, filed Apr. 24, 2006.

FIELD OF INVENTION

The present invention relates to a lubricating composition containing a polymer such as a star polymer, a phosphorus-containing compound and a dispersant. The invention further provides a method for lubricating a mechanical device using the lubricating composition.

BACKGROUND OF THE INVENTION

The use of star polymers in lubricating compositions is known. The star polymers known in lubricating compositions are summarised in the prior art below.

International Application WO 04/087850 discloses lubricating compositions containing block copolymers prepared from RAFT (Reversible Addition Fragmentation Transfer) or ATRP (Atom Transfer Radical Polymerisation) polymerisation processes. The polymers have frictional properties. The block copolymer may have di-block, tri-block, multi-block, comb and/or star architecture. However, no guidance is given on methods suitable to prepare star copolymers. Also disclosed are polymers suitable for greases, motor oils, gearbox oils, turbine oils, hydraulic fluids, pump oils, heat transfer oils, insulation oils, cutting oils and cylinder oils.

U.S. patent application Ser. No. 05/038,146 discloses star polymers derived from (i) a core portion comprising a polyvalent (meth) acrylic monomer, oligomer or polymer thereof or a polyvalent divinyl non-acrylic monomer, oligomer or polymer thereof, and (ii) at least two arms of polymerized alkyl (meth)acrylate ester. The polymers may be prepared by RAFT, ATRP or nitroxide mediated techniques.

International Application WO 96/23012 discloses star-branched polymers prepared from acrylic or methacrylic monomers. The polymers have a core or nucleus derived from acrylate or methacrylate esters of polyols. Further the polymers have molecular weights and other physical characteristics that make them useful for lubricating oil compositions. The star-branched polymers disclosed are prepared by anionic polymerisation techniques.

The star polymers of EP 979 834 require from 5 to 10 weight percent of a C16 to C30 alkyl(meth)acrylate and from 5 to 15 weight percent of butyl methacrylate. A viscosity index improver with a C16 to C30 alkyl(meth) acrylate monomer present at 5 weight percent or more has reduced low temperature viscosity performance because the polymer has a waxy texture.

U.S. Pat. No. 5,070,131 disclose gear oil compositions having improved shear stability index essentially consisting of gear oil, a viscosity index improver comprising a hydrogenated star polymer comprising at least four arms, the arms comprising, before hydrogenation, polymerized conjugated diolefin monomer units and the arms having a number average molecular weight within the range of 3,000 to 15,000.

None of the prior art references above disclose fully formulated lubricating compositions that simultaneously achieve acceptable viscosity index (VI), oil blend thickening capabilities, improved fuel economy, good shear stability, good low temperature viscosity performance, and low viscosity modifier treatment level whilst maintaining the appropriate lubricating performance for a mechanical device, such as automatic transmissions.

In view of the prior art it would be advantageous to have a lubricating composition containing a polymer that is capable of providing acceptable viscosity index (VI), oil blend thickening capabilities, shear stability, good low temperature viscosity performance, and low viscosity modifier treatment level whilst maintaining the appropriate lubricating performance for a mechanical device.

The present invention provides a lubricating composition capable of providing acceptable viscosity index (VI), oil blend thickening capabilities, shear stability, good low temperature viscosity performance, and low viscosity modifier treatment level whilst maintaining the appropriate lubricating performance for a mechanical device.

The prior art references, specifically WO 96/23012 and U.S. Pat. No. 5,070,131 employ anionic polymerisation techniques to prepare the polymer. Anionic polymerisation techniques are believed to involve complex processes that require systems to be substantially water-free, acid-free, oxygen-free, dry, clean, and have non-contaminated vessels. In one particular embodiment it would be advantageous to have a lubricating composition that does not require a polymer prepared with complex processes that require oxygen-free, dry, clean, non-contaminated vessels. In one embodiment the lubricating composition contains a polymer that does not require preparation by anionic polymerisation techniques.

SUMMARY OF THE INVENTION

In one embodiment the invention provides a lubricating composition comprising:

(a) 0.1 to 15 wt % of a polymer with (i) a weight average molecular weight of 100,000 to 500,000; and (ii) a shear stability index of 10 to 60;

(b) a phosphorus-containing acid, salt, or ester;

(c) a dispersant; and (d) an oil of lubricating viscosity.

In one embodiment the invention provides a lubricating composition comprising:

(a) 0.1 to 15 wt % of a polymer with (i) a weight average molecular weight of 100,000 to 500,000; and (ii) a shear stability index of 10 to 60;

(b) a phosphorus-containing acid, salt, or ester;

(c) a dispersant;

(d) a friction modifier; and (e) an oil of lubricating viscosity.

In one embodiment the invention provides a lubricating composition comprising:

(a) 0.1 to 15 wt % of a polymer with (i) a weight average molecular weight of 100,000 to 500,000; and (ii) a shear stability index of 10 to 60;

(b) 0.01 wt % to 20 wt % of a phosphorus-containing acid, salt, or ester;

(c) 0.01 wt % to 20 wt % of a dispersant; and (d) 10 wt % to 99.88 wt % of an oil of lubricating viscosity.

In one embodiment the invention provides a lubricating composition comprising:

(a) 0.1 to 15 wt % of a polymer with radial or star architecture;

(b) a phosphorus-containing acid, salt, or ester;

(c) a dispersant; and (d) an oil of lubricating viscosity.

In one embodiment the invention provides a lubricating composition comprising:

(a) 0.1 to 15 wt % of a polymer with radial or star architecture;

(b) a phosphorus-containing acid, salt, or ester;

(c) a dispersant;

(d) a friction modifier; and (e) an oil of lubricating viscosity.

In one embodiment the invention provides a lubricating composition comprising:

(a) 0.1 to 15 wt % of a polymer with a weight average molecular weight of 100,000 to 500,000, wherein the polymer has radial or star architecture;

(b) a phosphorus-containing acid, salt, or ester;

(c) a dispersant; and (d) an oil of lubricating viscosity.

In one embodiment the invention provides a lubricating composition comprising:

(a) 0.1 to 15 wt % of a polymer with a weight average molecular weight of 100,000 to 500,000, wherein the polymer has radial or star architecture;

(b) a phosphorus-containing acid, salt, or ester;

(c) a dispersant;

(d) a friction modifier; and (e) an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a gear, a gearbox or a transmission, and wherein the lubricating composition comprises:

(a) 0.1 to 15 wt % of a polymer with (i) a weight average molecular weight of 100,000 to 500,000; and (ii) a shear stability index of 10 to 60;

(b) a phosphorus-containing acid, salt, or ester;

(c) a dispersant; and (d) an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a gear, a gearbox or a manual transmission, and wherein the lubricating composition comprises:

(a) 0.1 to 15 wt % of a polymer with radial or star architecture;

(b) a phosphorus-containing acid, salt, or ester;

(c) a dispersant; and (d) an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a gear, a gearbox or a manual transmission, and wherein the lubricating composition comprises:

(a) 0.1 to 15 wt % of a polymer with a weight average molecular weight of 100,000 to 500,000, wherein the polymer has radial or star architecture;

(b) a phosphorus-containing acid, salt, or ester;

(c) a dispersant; and (d) an oil of lubricating viscosity.

In one embodiment the invention provides a method for lubricating a mechanical device comprising a supplying to the mechanical device a lubricating composition, wherein the mechanical device is an automatic transmission, a traction drive transmission, a manual transmission, a dual clutch transmission or a continuously variable transmission, and wherein the lubricating composition comprises:

(a) a polymer derived from 20 wt % or more of a mono-vinyl monomer, wherein the polymer has a weight average molecular weight of 100,000 to 500,000, and wherein the polymer has a shear stability index of 10 to 60;

(b) a phosphorus-containing acid, salt, or ester;

(c) a dispersant; and (d) an oil of lubricating viscosity.

In one embodiment the invention provides a method for lubricating a mechanical device comprising a supplying to the mechanical device a lubricating composition, wherein the mechanical device is an automatic transmission, a traction drive transmission, a manual transmission, a dual clutch transmission or a continuously variable transmission, and wherein the lubricating composition comprises:

(a) 0.1 to 15 wt % of a polymer with radial or star architecture;

(b) a phosphorus-containing acid, salt, or ester;

(c) a dispersant; and (d) an oil of lubricating viscosity.

In one embodiment the invention provides a method for lubricating a mechanical device comprising a supplying to the mechanical device a lubricating composition, wherein the mechanical device is an automatic transmission, a traction drive transmission, a manual transmission, a dual clutch transmission or a continuously variable transmission, and wherein the lubricating composition comprises:

(a) 0.1 to 15 wt % of a polymer with a weight average molecular weight of 100,000 to 500,000, wherein the polymer has radial or star architecture;

(b) a phosphorus-containing acid, salt, or ester;

(c) a dispersant; and (d) an oil of lubricating viscosity.

DETAILED DESCRIPTION OF THE INVENTION

The present invention provides a lubricating composition and a method for lubricating a mechanical device as disclosed above.

Polymer

As used herein terms such as "the polymer has (or contains) monomers composed of" means the polymer comprises units derived from the particular monomer referred to.

In different embodiments the polymer may contain about 20 wt % or more, or greater than 50 wt %, or about 55 wt % or more, or about 70 wt % or more, or about 90 wt % or more, or about 95 wt % or more, or about 100 wt % of a non-diene monomer (that is to say, non-diene monomer units or units derived from polymerisation of one of more non-diene monomers). Examples of diene monomers include 1,3-butadiene or isoprene. Examples of a non-diene or mono-vinyl monomer include styrene, methacrylates, or acrylates.

In one embodiment the polymer may be derived from 20 wt % or more of a mono-vinyl monomer, wherein the polymer has a weight average molecular weight of 100,000 to 500,000, and wherein the polymer has radial or star architecture.

When the polymer is a radial or star polymer, the amount of mono-vinyl monomer as described above refers only to the composition of the polymeric arms, i.e., the wt % values as given are exclusive of any di-functional (or higher) monomer found in a polymer core.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312. As used herein the weight average and number weight average molecular weights of the polymers of the invention are obtained by integrating the area under the peak corresponding to the polymer of the invention, which is normally the major high molecular weight peak, excluding peaks associated with diluents, impurities, uncoupled polymer chains and other additives. Typically, the polymer of the invention has radial or star architecture.

The weight average molecular weight of the polymer may be in the range of 125,000 to 400,000, or 175,000 to 375,000 or 225,000 to 325,000.

As used herein the shear stability may be determined by a 20 hour KRL test (Volkswagen Tapered Bearing Roller Test). The test procedure is set out in both CEC-L-45-A-99 and DIN 51350-6-KRL/C. The shear stability index (SSI) is calculated from the formula SSI=100×(fluid viscosity before shear−fluid viscosity after shear)/(fluid viscosity before shear−fluid viscosity without VM). The polymer SSI may be in the range of 10 to 60, or 15 to 50, or 20 to 45.

The polymer may be a homopolymer or a copolymer. In one embodiment the polymer is a copolymer. The polymer may have a branched, a comb-like, a radial or a star architecture. In one embodiment the polymer may be a radial or star polymer, or mixtures thereof. The polymer may be a polymer having a random, tapered, di-block, tri-block or multi-block architecture. Typically the polymer has random or tapered architecture.

When the polymer has branched, comb-like, radial or star architecture, the polymer has polymeric arms. For such materials, the polymeric arms may have block architecture, or hetero architecture, or tapered-block architecture. Tapered-block architecture has a variable composition across the length of a polymer arm. For example, a tapered-block arm may be composed of, at one end, a relatively pure first monomer and, at the other end, a relatively pure second monomer. The middle of the arm is more of a gradient composition of the two monomers.

The polymer derived from a block-arm typically contains one or more polymer arms derived from two or more monomers in block structure within the same arm. A more detailed description of the block-arm is given in Chapter 13 (pp. 333-368) of "Anionic Polymerization, Principles and Practical Applications" by Henry Hsieh and Roderic Quirk (Marcel Dekker, Inc, New York, 1996) (hereinafter referred to as Hsieh et al.).

The hetero-arm, or "mikto-arm," polymeric arm architecture typically contains arms which may vary from one another either in molecular weight, composition, or both, as defined in Hsieh et al., cited above. For example, a portion of the arms of a given polymer may be of one polymeric type and a portion of a second polymeric type. More complex hetero-arm polymers may be formed by combining portions of three or more polymeric arms with a coupling agent.

When the polymer has radial or star architecture the polymeric arms may be chemically bonded to a core portion. The core portion may be a polyvalent (meth)acrylic monomer, oligomer, polymer, or copolymer thereof, or a polyvalent divinyl non-acrylic monomer, oligomer polymer, or copolymer thereof. In one embodiment the polyvalent divinyl non-acrylic monomer is divinyl benzene. In one embodiment the polyvalent (meth)acrylic monomer is an acrylate or methacrylate ester of a polyol or a methacrylamide of a polyamine, such as an amide of a polyamine, for instance a methacrylamide or an acrylamide. In different embodiments the polyvalent (meth)acrylic monomer is (i) a condensation reaction product of an acrylic or methacrylic acid with a polyol or (ii) a condensation reaction product of an acrylic or methacrylic acid with a polyamine.

The polyol which may be condensed with the acrylic or methacrylic acid in one embodiment contains 2 to 20 carbon atoms, in another embodiment 3 to 15 carbon atoms and in another embodiment 4 to 12 carbon atoms; and the number of hydroxyl groups present in one embodiment is 2 to 10, in another embodiment 2 to 4 and in another embodiment 2. Examples of polyols include ethylene glycol, poly(ethylene glycols), alkane diols such as 1,6 hexanene diol or triols such as trimethylolpropane, oligomerised trimethylolpropanes such as Boltorn® materials sold by Perstorp Polyols. Examples of polyamines include polyalkylenepolyamines such as ethylenediamine, diethylenetriamine, triethylenetetramine, tetraethylene pentamine, pentaethylenehexamine and mixtures thereof.

Examples of the polyvalent unsaturated (meth)acrylic monomer include ethylene glycol diacrylate, ethylene glycol dimethacrylate, diethylene glycol diacrylate, diethylene glycol dimethacrylate, glycerol diacrylate, glycerol triacrylate, mannitol hexaacrylate, 4-cyclohexanediol diacrylate, 1,4-benzenediol dimethacrylate, pentaerythritol tetraacrylate, 1,3-propanediol diacrylate, 1,5-pentanediol dimethacrylate, bis-acrylates and methacrylates of polyethylene glycols of molecular weight 200-4000, polycaprolactonediol diacrylate, pentaerythritol triacrylate, 1,1,1-trimethylolpropane triacrylate, pentaerythritol diacrylate, pentaerythritol triacrylate, pentaerythritol tetraacrylate, triethylene glycol diacrylate, triethylene glycol dimethacrylate, 1,1,1-trimethylolpropane trimethacrylate, hexamethylenediol diacrylate or hexamethylenediol dimethacrylate or an alkylene bis-(meth) acrylamide.

The amount of polyvalent coupling agent may be an amount suitable to provide coupling of polymer previously prepared as arms onto a core comprising the coupling agent in monomeric, oligomeric, or polymeric form, to provide a star polymer. As described above, suitable amounts may be determined readily by the person skilled in the art with minimal experimentation, even though several variables may be involved. For example, if an excessive amount of coupling agent is employed, or if excessive unreacted monomer from the formation of the polymeric arms remains in the system, crosslinking rather than star formation may occur. Typically the mole ratio of polymer arms to coupling agent may be 50:1 to 1.5:1 (or 1:1), or 30:1 to 2:1, or 10:1 to 3:1, or 7:1 to 4:1, or 4:1 to 1:1. In other embodiments the mole ratio of polymer arms to coupling agent may be 50:1 to 0.5:1, or 30:1 to 1:1, or 7:1 to 2:1. The desired ratio may also be adjusted to take into account the length of the arms, longer arms sometimes tolerating or requiring more coupling agent than shorter arms. Typically the material prepared is soluble in an oil of lubricating viscosity.

In one embodiment the polymeric arms of the polymer have a polydispersity of 2 or less, or 1.7 or less, or 1.5 or less, for instance, 1 to 1.4 as measured before radial or star polymer formation or on uncoupled units. In one embodiment the overall polymer composition, which includes the polymer with radial or star architecture, has polydispersity with a bimodal or higher modal distribution. The bimodal or higher distribution in the overall composition is believed to be partially due to the presence of varying amounts of uncoupled polymer chains and/or uncoupled radial or star-polymers or star-to-star coupling formed as the polymer is prepared.

The overall composition containing polymers with the radial or star architecture may thus also have uncoupled polymeric arms present (also referred to as a polymer chain or linear polymer). The percentage conversion of a polymer chain to radial or star polymer may be at least 10%, or at least 20%, or at least 40%, or at least 55%, for instance at least 70%, at least 75% or at least 80%. In one embodiment the conversion of polymer chain to radial or star polymer may be 90%, 95% or 100%. In one embodiment a portion of the polymer chains does not form a star polymer and remains as a linear polymer. In one embodiment the polymer is a mixture of (i) a polymer with radial or star architecture, and (ii) linear polymer chains (also referred to as uncoupled polymeric arms). In different embodiments the amount of radial or star architecture within the polymer composition may be 10 wt % to 85 wt %, or 25 wt % to 70 wt % of the amount of polymer. In different embodiments the linear polymer chains may be present at 15 wt % to 90 wt %, or 30 wt % to 75 wt % of the amount of polymer.

The polymer with branched, comb-like, radial or star architecture may have 2 or more arms, or 5 or more arms, or 7 or more arms, or 10 or more arms, for instance 12 to 100, or 14 to 50, or 16 to 40 arms. The polymer with branched, comb-like, radial or star architecture may have 120 arms or less, or 80 arms or less, or 60 arms or less.

The polymer may be obtained/obtainable from a controlled radical polymerisation technique. Examples of a controlled radical polymerisation technique include RAFT, ATRP or nitroxide mediated processes. The polymer may also be obtained/obtainable from anionic polymerisation processes. In one embodiment the polymer may be obtained/obtainable from RAFT, ATRP or anionic polymerisation processes. In one embodiment the polymer may be obtained/obtainable from RAFT or ATRP polymerisation processes. In one embodiment the polymer may be obtained/obtainable from a RAFT polymerisation process.

Methods of preparing polymers using ATRP, RAFT or nitroxide-mediated techniques are disclosed in the example section of U.S. patent application Ser. No. 05/038,146, examples 1 to 47.

More detailed descriptions of polymerisation mechanisms and related chemistry is discussed for nitroxide-mediated polymerisation (Chapter 10, pages 463 to 522), ATRP (Chapter 11, pages 523 to 628) and RAFT (Chapter 12, pages 629 to 690) in the Handbook of Radical Polymerization, edited by Krzysztof Matyjaszewski and Thomas P. Davis, 2002, published by John Wiley and Sons Inc (hereinafter referred to as "Matyjaszewski et al.").

The discussion of the polymer mechanism of ATRP polymerisation is shown on page 524 in reaction scheme 11.1, page 566 reaction scheme 11.4, reaction scheme 11.7 on page 571, reaction scheme 11.8 on page 572 and reaction scheme 11.9 on page 575 of Matyjaszewski et al.

In ATRP polymerisation, groups that may be transferred by a radical mechanism include halogens (from a halogen-containing compound) or various ligands. A more detailed review of groups that may be transferred is described in U.S. Pat. No. 6,391,996, or paragraphs 61 to 65 of U.S. patent application Ser. No. 05/038,146.

Examples of a halogen-containing compound that may be used in ATRP polymerisation include benzyl halides such as p-chloromethylstyrene, α-dichloroxylene, α,α-dichloroxylene, α,α-dibromoxylene, hexakis(α-bromomethyl)benzene, benzyl chloride, benzyl bromide, 1-bromo-1-phenylethane and 1-chloro-1-phenylethane; carboxylic acid derivatives which are halogenated at the α-position, such as propyl 2-bromopropionate, methyl 2-chloropropionate, ethyl 2-chloropropionate, methyl 2-bromopropionate, and ethyl 2-bromoisobutyrate; tosyl halides such as p-toluenesulfonyl chloride; alkyl halides such as tetrachloromethane, tribromomethane, 1-vinylethyl chloride, and 1-vinylethyl bromide; and halogen derivatives of phosphoric acid esters, such as dimethylphosphoric acid.

In one embodiment when the halogen compound is employed, a transition metal such as copper is also present. The transition metal may be in the form of a salt. The transition metal is capable of forming a metal-to-ligand bond and the ratio of ligand to metal depends on the dentate number of the ligand and the co-ordination number of the metal. The ligand may be a nitrogen or phosphorus-containing ligand.

Examples of a suitable ligand include triphenylphosphine, 2,2-bipyridine, alkyl-2,2-bipyridine, such as 4,4-di-(5-heptyl)-2,2-bipyridine, tris(2-aminoethyl)amine (TREN), N,N,N',N',N"-pentamethyldiethylenetriamine, 4,4-di-(5-nonyl)-2,2-bipyridine, 1,1,4,7,10,10-hexamethyltriethylenetetramine and/or tetramethylethylenediamine. Further suitable ligands are described in, for example, International Patent application WO 97/47661. The ligands may be used individually or as a mixture. In one embodiment the nitrogen containing ligand is employed in the presence of copper. In one embodiment the ligand is phosphorus-containing with triphenyl phosphine ($PPh_3$) a common ligand. A suitable transition metal for a triphenyl phosphine ligand includes Rh, Ru, Fe, Re, Ni or Pd.

In RAFT polymerisation, chain transfer agents are important. A more detailed review of suitable chain transfer agents is found in paragraphs 66 to 71 of U.S. patent application Ser. No. 05/038,146. Examples of a suitable RAFT chain transfer agent include benzyl 1-(2-pyrrolidinone)carbodithioate, benzyl (1,2-benzenedicarboximido)carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-5-benzyl dithiocarbamate, cyanomethyl 1-(2-pyrrolidone) carbodithoate, cumyl dithiobenzoate, 2-dodecylsulphanylthiocarbonylsulphanyl-2-methyl-propionic acid butyl ester, O-phenyl-S-benzyl xanthate, N,N-diethyl S-(2-ethoxy-carbonylprop-2-yl)dithiocarbamate, dithiobenzoic acid, 4-chlorodithiobenzoic acid, O-ethyl-S-(1-phenylethyl) xanthtate, O-ethyl-S-(2-(ethoxycarbonyl)prop-2-yl)xanthate, O-ethyl-S-(2-cyanoprop-2-yl)xanthate, O-ethyl-S-(2-cyanoprop-2-yl)xanthate, O-ethyl-S-cyanomethyl xanthate, O-pentafluorophenyl-S-benzyl xanthate, 3-benzylthio-5,5-dimethylcyclohex-2-ene-1-thione or benzyl 3,3-di(benzylthio)prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(α,α'-disubstituted-α"-acetic acid)-trithiocarbonates, benzyl dithiobenzoate, 1-phenylethyl dithiobenzoate, 2-phenylprop-2-yl dithiobenzoate, 1-acetoxyethyl dithiobenzoate, hexakis(thiobenzoylthiomethyl)benzene, 1,4-bis(thiobenzoylthiomethyl)benzene, 1,2,4,5-tetrakis(thiobenzoylthiomethyl)benzene, 1,4-bis-(2-(thiobenzoylthio)-prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof.

In one embodiment a suitable RAFT chain transfer agent includes 2-dodecylsulfanylthiocarbonylsulfanyl-2-methylpropionic acid butyl ester, cumyl dithiobenzoate or mixtures thereof.

A discussion of the polymer mechanism of RAFT polymerisation is shown on page 664 to 665 in section 12.4.4 of Matyjaszewski et al.

When the polymer is prepared from anionic polymerisation techniques, initiators include, for example, hydrocarbyllithium initiators such as alkyllithium compounds (e.g., methyl lithium, n-butyl lithium, sec-butyl lithium), cycloalkyllithium compounds (e.g., cyclohexyl lithium and aryl lithium compounds (e.g., phenyl lithium, 1-methylstyryl lithium, p-tolyl lithium, naphyl lithium and 1,1-diphenyl-3-methylpentyl lithium. Also, useful initiators include naphthalene sodium, 1,4-disodio-1,1,4,4-tetraphenylbutane, diphenylmethyl potassium or diphenylmethylsodium.

The polymerisation process may also be carried out in the absence of moisture and oxygen and in the presence of at least one inert solvent. In one embodiment anionic polymerisation is conducted in the absence of any impurity which is detrimental to an anionic catalyst system. The inert solvent includes a hydrocarbon, an aromatic solvent or ether. Suitable solvents include isobutane, pentane, cyclohexane, benzene, toluene, xylene, tetrahydrofuran, diglyme, tetraglyme, orthoterphenyl, biphenyl, decalin or tetralin.

The anionic polymerisation process may be carried out at a temperature of 0° C. to −78° C.

A more detailed description of process to prepare the polymer derived from anionic processes is discussed in International Patent Application WO 96/23012, page 3, line 11 to page 5, line 8. Page 7, line 25 to page 10, line 15 of WO 96/23012 further describes methods of preparing polymers by anionic polymerisation techniques. A detailed description of anionic polymerisation process is given in Textbook of Polymer Science, edited by Fred W. Billmeyer Jr., Third Edition, 1984, Chapter 4, pages 88-90.

The polymer may comprise at least one of (a) a polymer derived from monomers comprising: (i) a vinyl aromatic monomer; and (ii) a carboxylic monomer (typically maleic anhydride, maleic acid, (meth)acrylic acid, itaconic anhydride or itaconic acid) or derivatives thereof; (b) a poly (meth)acrylate; (c) a functionalised polyolefin; (d) an ethylene vinyl acetate copolymer; (e) a fumarate copolymer; (f) a copolymer derived from (i) an α-olefin and (ii) a carboxylic monomer (typically maleic anhydride, maleic acid, (meth)acrylic acid, itaconic anhydride or itaconic acid) or derivatives thereof; or (g) mixtures thereof. In one embodiment the polymer with pendant groups comprises a polymethacrylate or mixtures thereof.

When the polymer is a polymethacrylate, the polymer may be derived from a monomer composition comprising:

(a) 50 wt % to 100 wt % (or 65 wt % to 95 wt %) of an alkyl methacrylate, wherein the alkyl group of the methacrylate has 10 to 30, or 10 to 20, or 12 to 18, or 12 to 15 carbon atoms;

(b) 0 wt % to 40 wt % (or 5 wt % to 30 wt %) of an alkyl methacrylate, wherein the alkyl group of the methacrylate has 1 to 9, or 1 to 4 carbon atoms (for example methyl, butyl, or 2-ethylhexyl); and (c) 0 wt % to 10 wt % (or 0 wt % to 5 wt %) of a nitrogen-containing monomer.

As used herein the term (meth)acrylate means acrylate or methacrylate units. The alkyl(meth)acrylate includes for example compounds derived from saturated alcohols, such as methyl methacrylate, butyl methacrylate, 2-methylpentyl, 2-propylheptyl, 2-butyloctyl, 2-ethylhexyl(meth)acrylate, octyl(meth)acrylate, nonyl(meth)acrylate, isooctyl(meth) acrylate, isononyl(meth)acrylate, 2-tert-butylheptyl(meth) acrylate, 3-isopropylheptyl(meth)acrylate, decyl(meth)acrylate, undecyl(meth)acrylate, 5-methylundecyl(meth) acrylate, dodecyl(meth)acrylate, 2-methyldodecyl(meth) acrylate, tridecyl (meth)acrylate, 5-methyltridecyl(meth) acrylate, tetradecyl(meth)acrylate, pentadecyl(meth) acrylate, hexadecyl(meth)acrylate, 2-methylhexadecyl (meth)acrylate, heptadecyl(meth)acrylate, 5-isopropylheptadecyl(meth)acrylate, 4-tert-butyloctadecyl(meth)acrylate, 5-ethyloctadecyl(meth)acrylate, 3-isopropyloctadecyl-(meth)acrylate, octadecyl(meth)acrylate, nonadecyl (meth) acrylate, eicosyl(meth)acrylate, cetyleicosyl(meth)acrylate, stearyleicosyl(meth)acrylate, docosyl(meth)acrylate and/or eicosyltetratriacontyl(meth)acrylate; (meth)acrylates derived from unsaturated alcohols, such as oleyl(meth) acrylate; and cycloalkyl(meth)acrylates, such as 3-vinyl-2-butylcyclohexyl(meth)acrylate or bornyl(meth)acrylate.

The alkyl(meth)acrylates with long-chain alcohol-derived groups may be obtained, for example, by reaction of a (meth)acrylic acid (by direct esterification) or methyl methacrylate (by transesterification) with long-chain fatty alcohols, in which reaction a mixture of esters such as (meth) acrylate with alcohol groups of various chain lengths is generally obtained. These fatty alcohols include-Oxo Alcohol® 7911, Oxo Alcohol® 7900 and Oxo Alcohol® 1100 of Monsanto; Alphanol®79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment the star polymer is further functionalised in the core or the polymeric arms with a nitrogen-containing monomer. The nitrogen-containing monomer may include a vinyl-substituted nitrogen heterocyclic monomer, a dialkylaminoalkyl(meth)acrylate monomer, a dialkylaminoalkyl (meth)acrylamide monomer, a tertiary-(meth) acrylamide monomer or mixtures thereof.

In one embodiment the core or polymeric arms further comprise a (meth)acrylamide or a nitrogen containing (meth)acrylate monomer that may be represented by the formula:

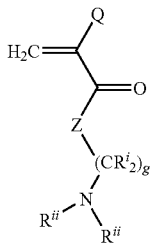

wherein

Q is hydrogen or methyl and, in one embodiment, Q is methyl;

Z is an N—H group or O (oxygen);

each $R^{ii}$ is independently hydrogen or a hydrocarbyl group containing 1 to 8, or 1 to 4 carbon atoms;

each $R^{i}$ is independently hydrogen or a hydrocarbyl group containing 1 to 2 carbon atoms and, in one embodiment, each $R^{i}$ is hydrogen; and g is an integer from 1 to 6 and, in one embodiment, g is 1 to 3.

Examples of a suitable nitrogen-containing monomer include N,N-dimethylacrylamide, N-vinyl carbonamides such as N-vinyl-formamide, vinyl pyridine, N-vinylacetoamide, N-vinyl-n-propionamides, N-vinyl hydroxyacetoamide, N-vinyl imidazole, N-vinyl pyrrolidinone, N-vinyl caprolactam, dimethylaminoethyl acrylate (DMAEA), dimethylaminoethylmethacrylate (DMAEMA), dimethylaminobutylacrylamide, dimethylamine-propylmethacrylate (DMAPMA), dimethylamine-propyl-acrylamide, dimethylaminopropylmethacrylamide, dimethylaminoethyl-acrylamide or mixtures thereof.

The polymer may be present in the lubricating composition at ranges including 0.5 to 12 wt %, or 1 to 10 wt %, or 2 to 8 wt %.

Phosphorus-Containing Acid, Salt or Ester

The phosphorus-containing acid, salt or ester may be a friction modifier, an antiwear agent, an extreme pressure agent or mixtures thereof. In one embodiment the phosphorus-containing acid, salt or ester is in the form of a mixture.

The phosphorus-containing acid, salt or ester may be metal-containing or metal free (prior to being mixed with other components).

The phosphorus-containing acid, salt or ester may be derived from a phosphoric acid, phosphorous acid, thiophosphoric acid, thiophosphorous acid, or mixtures thereof.

The phosphorus-containing acid, salt or ester includes (i) a non-ionic phosphorus compound; (ii) an amine salt of a phosphorus compound; (iii) an ammonium salt of a phosphorus compound; (iv) a monovalent metal salt of a phosphorus compound, such as a metal dialkyldithiophosphate or a metal dialkylphosphate; or (v) mixtures of (i), (ii), (iii) or (iv).

In one embodiment the phosphorus-containing acid, salt or ester comprises a metal dialkyldithiophosphate or a metal dialkylphosphate. The alkyl groups of the dialkyldithiophosphate and/or the dialkylphosphate may be linear or branched containing 2 to 20 carbon atoms, provided that the total number of carbons is sufficient to make the metal dialkyldithiophosphate oil soluble. The metal of the metal dialkyldithiophosphate and/or dialkylphosphate typically includes monovalent or divalent metals. Examples of suitable metals include sodium, potassium, copper, calcium, magnesium, barium or zinc. In one embodiment the phosphorus-containing acid, salt or ester is a zinc dialkyldithiophosphate. In one embodiment the phosphorus-containing acid, salt or ester is a zinc dialkylphosphate. Examples of a suitable zinc dialkylphosphate (often referred to as ZDDP, ZDP or ZDTP) include zinc di-(2-methylpropyl) dithiophosphate, zinc di-(amyl) dithiophosphate, zinc di-(1,3-dimethylbutyl) dithiophosphate, zinc di-(heptyl) dithiophosphate, zinc di-(octyl) dithiophosphate di-(2-ethylhexyl) dithiophosphate, zinc di-(nonyl) dithiophosphate, zinc di-(decyl) dithiophosphate, zinc di-(dodecyl) dithiophosphate, zinc di-(dodecylphenyl) dithiophosphate, zinc di-(heptylphenyl) dithiophosphate, or mixtures thereof.

In one embodiment the phosphorus-containing acid, salt or ester is other than metal dialkyldithiophosphate.

In one embodiment the phosphorus-containing acid is phosphoric acid.

In one embodiment the phosphorus-containing acid, salt or ester comprises an ammonium or amine salt of a phosphorus-containing acid or ester.

The amine salt of a phosphorus acid or ester includes phosphoric acid esters and amine salts thereof, dialkyldithiophosphoric acid esters and amine salts thereof; amine salts of phosphites; and amine salts of phosphorus-containing carboxylic esters, ethers, and amides; and mixtures thereof.

The amine salt of a phosphorus acid or ester may be used alone or in combination. In one embodiment the amine salt of a phosphorus compound is derived from an amine salt of a phosphorus compound, or mixtures thereof.

In one embodiment the amine salt of a phosphorus acid or ester includes a partial amine salt-partial metal salt compounds or mixtures thereof. In one embodiment the amine salt of a phosphorus acid or ester further comprises a sulphur atom in the molecule.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and olcyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with C11 to C14 tertiary alkyl primary groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid or ester is the reaction product of a C14 to C18 alkylated phosphoric acid with Primene 81R™ (produced and sold by Rohm & Haas) which is a mixture of C11 to C14 tertiary alkyl primary amines.

Examples of the amine salt of a phosphorus acid or ester include the reaction product(s) of isopropyl, methyl-amyl (1,3-dimethylbutyl or mixtures thereof), 2-ethylhexyl, heptyl, octyl or nonyl dithiophosphoric acids with ethylene diamine, morpholine, or Primene 81R™, and mixtures thereof.

In one embodiment a dithiophosphoric acid may be reacted with an epoxide or a glycol. This reaction product is further reacted with a phosphorus acid, anhydride, or lower ester (where "lower" signifies 1 to 8, or, 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols may be aliphatic glycols having 1 to 12, or 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(1,3-dimethylbutyl)phosphorodithioate (prepared by reacting di(1,3-dimethylbutyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment the phosphorus-containing acid, salt or ester comprises a non-ionic phosphorus compound. Typically the non-ionic phosphorus compound may have an oxidation of +3 or +5. The different embodiments comprise phosphite ester, phosphate esters, or mixtures thereof.

In one embodiment the phosphorus-containing acid, salt or ester comprises a non-ionic phosphorus compound that is a hydrocarbyl phosphite. The hydrocarbyl phosphite of the invention includes those represented by the formula:

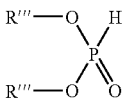

(I)

wherein each R''' may be independently hydrogen or a hydrocarbyl group, with the proviso that at least one of the R''' groups is hydrocarbyl.

Each hydrocarbyl group of R''' may contain at least 2 or 4 carbon atoms. Typically, the combined total sum of carbon atoms present on both R''' groups may be less than 45, less than 35 or less than 25. Examples of suitable ranges for the number of carbon atoms present on both R''' groups includes 2 to 40, 3 to 24 or 4 to 20. Examples of suitable hydrocarbyl groups include propyl, butyl, pentyl, hexyl dodecyl, butadecyl, hexadecyl, or octadecyl groups. Generally the hydrocarbyl phosphite is soluble or at least dispersible in oil. In one embodiment the hydrocarbyl phosphite may be di-butyl hydrogen phosphite or a $C_{16-18}$ alkyl hydrogen phosphite. A more detailed description of the non-ionic phosphorus compound include column 9, line 48 to column 11, line 8 of U.S. Pat. No. 6,103,673.

In different embodiments the phosphorus-containing acid, salt or ester may be at least one of phosphoric acid, di-n-butyl phosphite, dioleylphosphite, triphenylthiophosphate or triphenylphosphite.

The phosphorus-containing acid, salt or ester may be present in the lubricating composition at 0.01 wt % to 20 wt %, or 0.05 wt % to 10 wt %, or 0.1 wt % to 5 wt % of the lubricating composition.

The phosphorus-containing acid, salt or ester may provide 0.01 wt % to 0.3 wt %, or 0.02 wt % to 0.15% of phosphorus to the lubricating composition.

Dispersant

The lubricating composition comprises a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyetheramine dispersant.

In different embodiments the dispersant may be a succinimide, succinic acid ester, or Mannich dispersant.

In several embodiments the N-substituted long chain alkenyl succinimides contain an average of at least 8, or 30, or 35 up to 350, or to 200, or to 100 carbon atoms. In one embodiment, the long chain alkenyl group is derived from a polyalkene characterised by an $\overline{M}_n$ (number average molecular weight) of at least 500. Generally, the polyalkene is characterised by an $\overline{M}_n$ of 500, or 700, or 800, or even 900 up to 5000, or to 2500, or to 2000, or even to 1500 or 1200. In one embodiment the long chain alkenyl group is derived form polyolefins. The polyolefins may be derived from monomers including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful polyolefins include polyisobutylenes having a number average molecular weight of 400 to 5000, in another instance of 400 to 2500, and in a further instance of 400 or 500 to 1500. The polyisobutylene may have a vinylidene double bond content of 5 to 69%, in a second instance of 50 to 69%, and in a third instance of 50 to 95%.

In one embodiment the succinimide dispersant comprises a polyisobutylene-substituted succinimide, wherein the polyisobutylene-substituent has a number average molecular weight of 400 to 5000.

Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

Mannich dispersants are the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, which are commercially available.

Hydrocarbyl-amine dispersants are hydrocarbyl-substituted amines. The hydrocarbyl-substituted amine may be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines and their methods of preparation are described in greater detail in U.S. Pat. No. 6,458,172, columns 4 and 5.

In one embodiment the invention further comprises at least one dispersant derived from polyisobutylene, an amine and zinc oxide to form a polyisobutylene succinimide complex with zinc. The polyisobutylene succinimide complex with zinc may be used alone or in combination.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, phosphorus compounds and/or metal compounds. In one embodiment the dispersant is a borated dispersant. Typically the borated dispersant comprises the succinimide dispersant comprises a polyisobutylene succinimide, wherein the polyisobutylene has a number average molecular weight of 400 to 5000.

In one embodiment the dispersant is phosphorylated dispersant, or a borated phosphorylated dispersant.

In one embodiment the dispersant may be prepared by heating (i) a dispersant material described above (for example N-substituted long chain alkenyl succinimides), (ii) 2,5-dimercapto-1,3,4-thiadiazole or a hydrocarbyl-substituted 2,5-dimercapto-1,3,4-thiadiazole, or oligomers thereof, (iii) a borating agent, and (iv) optionally a dicarboxylic acid of an aromatic compound selected from the group consisting of 1,3 diacids and 1,4 diacids; or (v) optionally a phosphorus acid compound, said heating being sufficient to provide a product of (i), (ii), (iii) and optionally (iv) or (v), which is soluble in an oil of lubricating viscosity. The dispersant prepared by heating is described in more detail in U.S. patent application Ser. Nos. 04/027,094 and 60/654,164.

The dispersant may be present in the lubricating composition at 0.01 wt % to 20 wt %, or 0.05 wt % to 10 wt %, or 0.1 wt % to 5 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricrecsyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≤0.03 wt %, and ≥90 wt % saturates, viscosity index 80-120); Group III (sulphur content≤0.03 wt %, and ≥90 wt % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the polymer, the phosphorus-containing acid, salt, or ester, the extreme pressure agent and other performance additives.

The lubricating composition may be in the form of a concentrate and/or a fully formulated lubricant. If the polymer, the phosphorus-containing phosphorus-containing acid, salt, or ester; and the extreme pressure agent, other than component (b) are in the form of a concentrate (which may be combined with additional oil to form, in whole or in part, a finished lubricant), the ratio of the of components (a), (b) and (c) (i.e. the polymer, the phosphorus-containing phosphorus-containing acid, salt, or ester; and the extreme pressure agent, other than component (b)) to the oil of lubricating viscosity and/or to diluent oil include the ranges of 1:99 to 99:1 by weight, or 80:20 to 10:90 by weight.

Other Performance Additive

The composition of the invention optionally further includes at least one other performance additive. The other performance additives include metal deactivators, detergents, viscosity index improvers (that is, viscosity modifiers other than the star polymer of the invention), antioxidants, corrosion inhibitors, foam inhibitors, demulsifiers, pour point depressants, seal swelling agents and mixtures thereof.

The total combined amount of the other performance additive compounds present on an oil free basis may include ranges of 0 wt % to 25 wt %, or 0.01 wt % to 20 wt %, or 0.1 wt % to 15 wt %, or 0.5 wt % to 10 wt %, or 1 to 5 wt % of the composition. Although one or more of the other performance additives may be present, it is common for the other performance additives to be present in different amounts relative to each other.

In one embodiment the lubricating composition further comprises a friction modifier other than a phosphorus-containing acid, salt or ester. The friction modifier may be present in ranges including 0 wt % to 5 wt %, or 0.1 wt % to 5 wt %, or 0.1 wt % to 4 wt %, or 0.25 wt % to 3.5 wt %, or 0.5 wt % to 2.5 wt %, or 1 wt % to 2.5 wt % of the lubricating composition.

Antioxidants include molybdenum compounds such as molybdenum dithiocarbamates, sulphurised olefins, sulphides such as tert-nonyl mercaptan reacted with propylene oxide (mole ratio 1:1), hindered phenols, aminic compounds such as phenylaphanaphthylamine or alkylated diphenylamines (typically di-nonyl diphenylamine, octyl diphenylamine, di-octyl diphenylamine); detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a dithiophosphoric acid, a saligenin, an alkylsalicylate, and a salixarate. The alkaline earth metal may be calcium, magnesium or barium. In different embodiments the detergent may be a magnesium sulphonate or a calcium sulphonate.

Antiscuffing agents including organic sulphides and polysulphides, such as benzyldisulphide, bis-(chlorobenzyl) disulphide, dibutyl tetrasulphide, di-tertiary butyl polysulphide, di-tert-butylsulphide, sulphurised Diels-Alder adducts or alkyl sulphenyl N'N-dialkyl dithiocarbamates; and extreme pressure (EP) agents including chlorinated wax, metal thiocarbamates, such as zinc dioctyldithiocarbamate and barium heptylphenol diacid may also be used in the composition of the invention. In one embodiment the antiwear agent comprises a sulphur-containing and/or phosphorus-containing antiwear agent.

The friction modifiers other than a phosphorus-containing acid, salt or ester may include fatty amines, borated glycerol esters, fatty acid amides, fatty epoxides, borated fatty epoxides, alkoxylated fatty amines, borated alkoxylated fatty amines, metal salts of fatty acids, fatty imidazolines, metal salts of alkyl salicylates, condensation products of carboxylic acids or polyalkylene-polyamines, or an amide of a hydroxyalkyl compound.

In one embodiment the friction modifier other than a phosphorus-containing acid, salt or ester may be formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, 19-21. The friction modifier disclosed in U.S. Patent Application 60/725,360 may be an amide represented by the formula $R^1R^2N—C(O)R^3$, wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 68 and 69). In one embodiment the amide of a hydroxylalkyl compound is prepared by reacting glycolic acid, that is, hydroxyacetic acid, $HO—CH_2—COOH$ with an amine.

In one embodiment the friction modifier other than a phosphorus-containing acid, salt or ester may be a secondary or tertiary amine being represented by the formula $R^4R^5NR^6$, wherein $R^4$ and $R^5$ are each independently an alkyl group of at least 6 carbon atoms and $R^6$ is hydrogen, a hydrocarbyl group, a hydroxyl-containing alkyl group, or an amine-containing alkyl group. A more detailed description of the friction modifier is described in U.S. patent application Ser. No. 05/037,897 in paragraphs 8 and 19 to 22.

In one embodiment the friction modifier other than a phosphorus-containing acid, salt or ester may be derived from the reaction of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in U.S. patent application Ser. No. 03/220,00 (or International Publication WO04/007652) in paragraphs 8 and 9 to 14.

Viscosity modifiers other than the polymer (a) of the invention, including hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, and esters of maleic anhydride-styrene copolymers. Conventional poly(meth)acrylate polymers may be derived from monomers substantially the same as those defined for the polymeric arms. However, the conventional poly(meth) acrylate is generally free of a functional group selected from a halogen, an —O—N═group and a —S—C(═S)— group. In one embodiment the polymer of the invention is mixed with a conventional viscosity modifier.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles (typically tolyltriazole), 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate, demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and seal swell agents including Exxon Necton-37™ (FN 1380) and Exxon Mineral Seal Oil (FN 3200); and dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; may also be used in the composition of the invention.

Industrial Application

The method of the invention is useful for lubricating a variety of mechanical devices. The mechanical device comprises at least one of is an internal combustion engine (for crankcase lubrication), a hydraulic system, a gear, a gearbox, a manual transmission, a traction drive transmission, an automatic transmission or a manual transmission.

The automatic transmission includes continuously variable transmissions (CVT), infinitely variable transmissions (IVT), Torridol transmissions, continuously slipping torque converted clutches (CSTCC), stepped automatic transmissions or dual clutch transmissions (DVT).

The lubricating composition suitable for the mechanical device such as an automatic transmission, may have a Brookfield viscosity at −40° C. (as determined by ASTM D2983 using a rheometer with Low Viscosity (LV) capabilities) with ranges including 15 mPa·s to 150,000 mPa·s, or 15 mPa·s to 50,000 mPa·s, or 15 mPa·s to 20,000 mPa·s, or to 15,000 mPa·s.

In different embodiments the lubricating composition suitable for the mechanical device may have a kinematic viscosity at 100° C. (as determined by D445) in ranges such as 2 to 10 $mm^2/s$, or 3 to 9 $mm^2/s$ or 4.5 to 7.5 $mm^2/s$.

The following examples provide illustrations of the invention. These examples are non exhaustive and are not intended to limit the scope of the invention.

EXAMPLES

Preparative Example 1 (Prep 1) A vessel equipped with a nitrogen inlet flowing at 28.3 L/hr, medium speed mechanical stirrer, a thermocouple and a water-cooled condenser is charged with 78.2 g of $C_{12-15}$ alkyl methacrylate, 20 g of methyl methacrylate, 1.8 g of dimethyl aminopropyl methacrylamide, 1.08 g of Trigonox™-21 (initiator), 4 g of bis-dodecyltrithiocarbonate (chain transfer agent) and 46.8 g of oil. The contents of the vessel are stirred under a nitrogen blanket for 20 minutes to ensure sufficient mixing. The nitrogen flow is reduced to 14.2 L/hr and the mixture is set to be heated to 90° C. for 3 hours. 5.95 g of ethylene glycol dimethacrylate is added to the vessel and the mixture is stirred at 90° C. for an additional 3 hours. The resultant polymer is then cooled to ambient temperature. The polymer is characterised as having a weight average molecular weight of 189,500 g/mol and having a number average molecular weight of 148,800 g/mol. The polymer is believed to have at least 4 polymeric arms (containing 78.2 wt % of $C_{12-15}$ alkylmethacrylate, 20 wt % of methyl methacrylate and 1.8 wt % of dimethyl aminopropyl methacrylamide).

Comparative Example 1 (CE1) is a linear polymer prepared by the following procedure. A vessel is equipped with a nitrogen inlet flowing at 28.3 L/hr, medium speed mechanical stirrer, an addition funnel, a thermocouple and a water-cooled condenser. The addition funnel is then charged with 1995 g of $C_{12-15}$ alkyl methacrylate, 500 g of methyl methacrylate, 45 g of dimethyl aminopropyl methacrylamide, 17.5 g of Trigonox™21 initiator and 17.5 g of n-dodecylmercaptan and the contents are added to the vessel. The contents of the vessel are shaken and mixed to ensure sufficient mixing. Then about one-third of the vessel contents are transferred into another vessel containing equipped with a mechanical overhead stirrer, water-cooled condenser, thermocouple, addition funnel and nitrogen inlet. The reaction mixture is then heated to 110° C. After the reaction temperature reaches an exotherm peak, the remaining two-thirds of the ⅔ of monomer mixture (from the first vessel) is added through the addition funnel over a period of about 90 minutes, before cooling the vessel to about 110° C. until the end of reaction. The vessel is charged with about 1.8 g of Trigonox™ 21 in about 16.4 g of oil. The contents of the vessel are stirred for about one hour before cooling to ambient temperature. The resultant polymer is characterised as having a weight average molecular weight of 38,000 g/mol and number average molecular weight of 20,100 g/mol.

Automatic transmission lubricating compositions 1 (LC 1) and a comparative lubricating composition 1 (COMPAR1) are prepared as shown in the table below. The balance of the lubricating composition is base oil. The automatic transmission lubricating compositions are then evaluated by determining the kinematic and Brookfield viscosities (by employing ASTM methods D445 at 100° C. (kinematic viscosity at 100° C., KV100) and D2983 at −40° C. (Brookfield viscosity at −40° C., BV-40) respectively). The viscosity index (VI) is also determined by employing ASTM method D2270. The results obtained are also shown in the table.

| | COMPAR1 | LC1 |
|---|---|---|
| Additives | | |
| Polymer Prep1 (wt %) | 0 | 6.9 |
| Polymer CE1 (wt %) | 8.9 | 0 |
| Phosphorus-containing acid, salt, or ester (wt %) | 0.13 | 0.13 |
| Dispersant (wt %) | 2.4 | 2.4 |
| Total amount of other additives* (wt %) | 2.5 | 2.5 |
| Characterisation Data | | |
| KV100 | 7.01 | 7.4 |
| KV100 after shear | 6.25 | 6.42 |
| BV-40 | 6930 | 5770 |
| VI | 210 | 233 |
| KRL shear % vis loss | 11 | 13 |
| SSI | 22 | 25 |

*includes at least one other performance additive including friction modifiers, antioxidants, corrosion inhibitors, foam inhibitors, demulsifiers, pour point depressants and seal swelling agents. Suitable other performance additives are disclosed above in the detailed description.

The data obtained indicates that whilst both the lubricating composition of the invention and the comparative example have approximately equal Kinematic Viscosity at 100° C., the lubricating composition of the invention has a significantly lower Brookfield viscosity and an increased viscosity index. As a consequence, the lubricating composition of the invention is capable of providing acceptable viscosity index (VI), oil blend thickening capabilities, shear stability, good low temperature viscosity performance, and low viscosity modifier treatment level whilst maintaining the appropriate lubricating performance for an automatic transmission fluid.

Preparative Example (Prep2) is produced by a similar process to Prep1, except the amounts of reactant vary. The reactants in Prep2 are 80 g of $C_{12-15}$ methacrylate, 20 g of methyl methacrylate, 0 g of dimethyl aminopropyl methacrylamide, 0.55 g of Trigonox™-21 (initiator), 4.1 g of bis-dodecyltrithiocarbonate (chain transfer agent), 48.2 g of oil and 6.05 g of ethylene glycol dimethacrylate.

An automatic transmission lubricating composition 2 (LC2) is prepared by blending 7.5 wt % of the polymer of Prep2 with a dispersant, a phosphorus-containing acid, salt, or ester and various other performance additives. The automatic transmission fluid is characterised as having a KV 100 of 7.12, a BV-40 of 8400 and a VI of 239.

Preparative Example 3 (Prep3) is prepared by a similar process to Prep1, except the amounts of reactant vary. The reactants in Prep3 are 4.8 g of $C_{16-18}$ methacrylate, 201.6 g of $C_{12-15}$ methacrylate, 24 g of 2-ethylhexyl methacrylate (used instead of methyl methacrylate), 9.6 g of dimethyl aminoethyl methacrylamide (instead of dimethyl aminopropyl methacrylamide), 13.5 g of Trigonox™-21, 13.5 g of bis-dodecyltrithiocarbonate, 750 g of oil and 14.3 g of ethylene glycol dimethacrylate.

Comparative Example 2 (CE2) is a linear polymer prepared by a similar process to CE1, except the amounts of reactant vary. The reactants are present at 2522 g of $C_{12-15}$ alkyl methacrylate, 300 g of 2-ethylhexyl methacrylate (instead of methyl methacrylate), 120 g of dimethyl aminopropyl methacrylamide, 13.5 g of Trigonox™21 initiator and 13.5 g of n-dodecylmercaptan.

Automatic transmission fluids (LC2 (invention) and COMPAR2 (comparative example)) are prepared by adding a sufficient amount of polymer to produce a lubricating composition with approximately equal VI. The automatic transmission fluids prepared contain 0.1 wt % of a phosphorus-containing acid, salt, or ester, 5.3 wt % of dispersant and 2.4 wt % of other performance additives (including and 0.2 wt % of a polyacrylate pour point depressant.). The lubricating composition characterisation data is shown below.

| Example | Lubricating Composition Viscosity ($mm^2/s$) | VI | BV-40 | Polymer Treat Rate (wt %) | After KRL shear vis ($mm^2/s$) | SSI |
|---|---|---|---|---|---|---|
| LC2 | 5.9 | 150 | 10,800 | 1.17 | 5.63 | 41 |
| COMPAR2 | 5.8 | 149 | 10,200 | 1.61 | 5.6 | 40 |
| LC2 | 7.1 | 170 | 12,400 | 2.67 | 6.18 | 41 |
| COMPAR2 | 6.8 | 165 | 11,400 | 4.34 | 6.1 | 36 |

The data obtained indicates that the lubricating composition of the invention is capable of delivering a polymer with a lower treat rate whilst maintaining the appropriate lubricating performance for an automatic transmission fluid.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become, apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) about 0.1 to about 15 wt % of a polymer with radial or star architecture, wherein polymer has a shear stability index of about 15 to about 50 measured by CEC-L-45-A-99;

(b) 0.1 wt % to 5 wt % of a phosphorus-containing acid, salt, or ester;

(c) 0.1 wt % to 5 wt % of a dispersant; and (d) an oil of lubricating viscosity, wherein the polymer is obtained from a RAFT or ATRP polymerisation process, wherein the polymer is a polymethacrylate polymer having 7 or more arms, and wherein the polymethacrylate is derived from a monomer composition consisting essentially of:

(a) about 65 wt % to about 95 wt % of an alkyl methacrylate comprising a mixture of alkyl methacrylates having 12 to 15 carbon atoms;

(b) about 5 wt % to about 30 wt % of an alkyl methacrylate, wherein the alkyl group of the methacrylate has about 1 to about 9 carbon atoms; and (c) about 0 wt % to about 10 wt % of a nitrogen containing monomer, wherein the polymethacrylate architecture is random or tapered.

2. The lubricating composition of claim 1, wherein the polymer contains about 70 wt % or more of a mono-vinyl monomer.

3. The lubricating composition of claim 1, wherein the polymer has a weight average molecular weight in the range of about 125,000 to about 400,000.

4. The lubricating composition of claim 1, wherein the lubricating composition further comprises a component of linear polymer chains.

5. The lubricating composition of claim 1, wherein the polymer is present at about 0.5 to about 12 wt % of the lubricating composition.

6. The lubricating composition of claim 1, wherein the phosphorus-containing acid, salt or ester is metal free.

7. The lubricating composition of claim 1, wherein the phosphorus-containing acid, salt or ester is phosphoric acid.

8. The lubricating composition of claim 1, wherein the phosphorus-containing acid, salt or ester comprises at least one of (i) a non-ionic phosphorus compound; (ii) an amine salt of a phosphorus compound; (iii) ammonium salt of a phosphorus compound; (iv) a monovalent metal salt of a phosphorus compound; or (v) mixtures of (i), (ii), (iii) or (iv).

9. The lubricating composition of claim 1, wherein the phosphorus-containing acid, salt or ester comprises di-n-butyl phosphite, dioleylphosphite, triphenylthiophosphate, triphenylphosphite or phosphoric acid.

10. The lubricating composition of claim 1, wherein the dispersant comprises a succinimide, succinic acid ester, or Mannich dispersant.

11. The lubricating composition of claim 1, wherein the dispersant is a borated dispersant, a phosphorylated dispersant, or a borated phosphorylated dispersant.

12. The lubricating composition of claim 1, wherein the dispersant is prepared by heating (i) a succinimide, succinic acid ester, or Mannich dispersant, (ii) 2,5-dimercapto-1,3,4-thiadiazole or a hydrocarbyl-substituted 2,5-dimercapto-1,3,4-thiadiazole, or oligomers thereof, (iii) a borating agent, and (iv) optionally a dicarboxylic acid of an aromatic compound selected from the group consisting of 1,3 diacids and 1,4 diacids; or (v) optionally a phosphorus acid compound, said heating being sufficient to provide a product of (i), (ii), (iii) and optionally (iv) or (v), which is soluble in an oil of lubricating viscosity.

13. The lubricating composition of claim 1 further comprising a friction modifier other than a phosphorus-containing acid, salt or ester, or mixtures thereof.

14. The lubricating composition of claim 13, wherein the friction modifier comprises at least one of fatty amines, borated glycerol esters, fatty acid amides, fatty epoxides, borated fatty epoxides, alkoxylated fatty amines, borated alkoxylated fatty amines, metal salts of fatty acids, fatty imidazolines, metal salts of alkyl salicylates, condensation products of carboxylic acids or polyalkylene-polyamines.

15. The lubricating composition of claim 13, wherein the friction modifier is an amide represented by the formula $R^1R^2N—C(O)R^3$, wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent.

16. The lubricating composition of claim 13, wherein the friction modifier is a secondary or tertiary amine being represented by the formula $R^4R^5NR^6$, wherein $R^4$ and $R^5$ are each independently an alkyl group of at least 6 carbon atoms and $R^6$ is hydrogen, a hydrocarbyl group, a hydroxyl-containing alkyl group, or an amine-containing alkyl group.

17. The lubricating composition of claim 13, wherein the friction modifier is derived from the reaction of a carboxylic acid or a reactive equivalent thereof with an aminoalcohol, wherein the friction modifier contains at least two hydrocarbyl groups, each containing at least 6 carbon atoms.

18. A method for lubricating a mechanical device comprising supplying to the mechanical device a lubricating composition, wherein the mechanical device is an automatic transmission, a traction drive transmission, a manual transmission, a dual clutch transmission or a continuously variable transmission, and wherein the lubricating composition comprises:

(a) about 0.1 to about 15 wt % of a polymer with a weight average molecular weight of about 100,000 to about 500,000, wherein the polymer has radial or star architecture, wherein polymer has a shear stability index is about 15 to about 50 measured by CEC-L-45-A-99;

(b) 0.1 wt % to 5 wt % of a phosphorus-containing acid, salt, or ester;

(c) 0.1 wt % to 5 wt % of a dispersant; and (d) an oil of lubricating viscosity, wherein the polymer is obtained from a RAFT or ATRP polymerisation process, wherein the polymer is a polymethacrylate polymer having 7 or more arms, and wherein the polymethacrylate is derived from a monomer composition consisting essentially of:

(a) about 65 wt % to about 95 wt % of an alkyl methacrylate comprising a mixture of alkyl methacrylates having 12 to 15 carbon atoms, (b) about 5 wt % to about 30 wt % of an alkyl methacrylate, wherein the alkyl group of the methacrylate has about 1 to about 9 carbon atoms; and (c) about 0 wt % to about 10 wt % of a nitrogen containing monomer, wherein the polymethacrylate architecture is random or tapered.

19. The lubricating composition of claim 1, wherein the polymethacrylate architecture is random.

20. The method of claim 18, wherein the polymethacrylate architecture is tapered.

* * * * *